US010870957B2

(12) United States Patent
Sprague

(10) Patent No.: US 10,870,957 B2
(45) Date of Patent: Dec. 22, 2020

(54) BARRIER STAND

(71) Applicant: ABSOLUTE MUSEUM & GALLERY PRODUCTS LIMITED, Sheffield (GB)

(72) Inventor: Samuel Sprague, Lynton (GB)

(73) Assignee: ABSOLUTE MUSEUM & GALLERY PRODUCTS LIMITED (GB)

( * ) Notice: Subject to any disclaimer, the term of this patent is extended or adjusted under 35 U.S.C. 154(b) by 0 days.

(21) Appl. No.: 16/302,005

(22) PCT Filed: May 16, 2017

(86) PCT No.: PCT/GB2017/000076
§ 371 (c)(1),
(2) Date: Nov. 15, 2018

(87) PCT Pub. No.: WO2017/198984
PCT Pub. Date: Nov. 23, 2017

(65) Prior Publication Data

US 2019/0186091 A1 Jun. 20, 2019

(30) Foreign Application Priority Data

May 16, 2016 (GB) ..... 1608561.5

(51) Int. Cl.
*E01F 13/04* (2006.01)
*E01F 13/02* (2006.01)

(52) U.S. Cl.
CPC ..... *E01F 13/022* (2013.01); *E01F 13/028* (2013.01)

(58) Field of Classification Search
CPC ... E01F 15/06; E01F 15/10; E01F 9/60; E01F 13/028; E04H 2017/1465;
(Continued)

(56) References Cited

U.S. PATENT DOCUMENTS 1,136,746 A * 4/1915 White ..... E04H 17/10 256/48
1,267,116 A * 5/1918 Regel ..... E04H 17/10 256/54

(Continued)

FOREIGN PATENT DOCUMENTS

DE 20202830 U1 7/2002
EP 0 303 414 A1 2/1989

(Continued)

OTHER PUBLICATIONS

International Search Report and Written Opinion issued in corresponding application No. PCT/GB2017/000076, dated Aug. 1, 2017.

(Continued)

*Primary Examiner* — Thomas B Will
*Assistant Examiner* — Katherine J Chu
(74) *Attorney, Agent, or Firm* — Valeriya Svystun; Day Pitney LLP

(57) ABSTRACT

A barrier stand for a barrier comprising an elastic cable, has an elongate member (2) of generally tubular form and being adapted to be mounted on a base so as to stand in a vertical position. The stand has a hollow top section, and at least one slot (6) extending downwardly from the top of the top section and being open at its upper end, the slot (6) being adapted to receive a cable. A clamping device (4) is located in the hollow section and is biased resiliently to a clamping position for clamping a cable securely to the stand.

12 Claims, 1 Drawing Sheet

Figure 1:
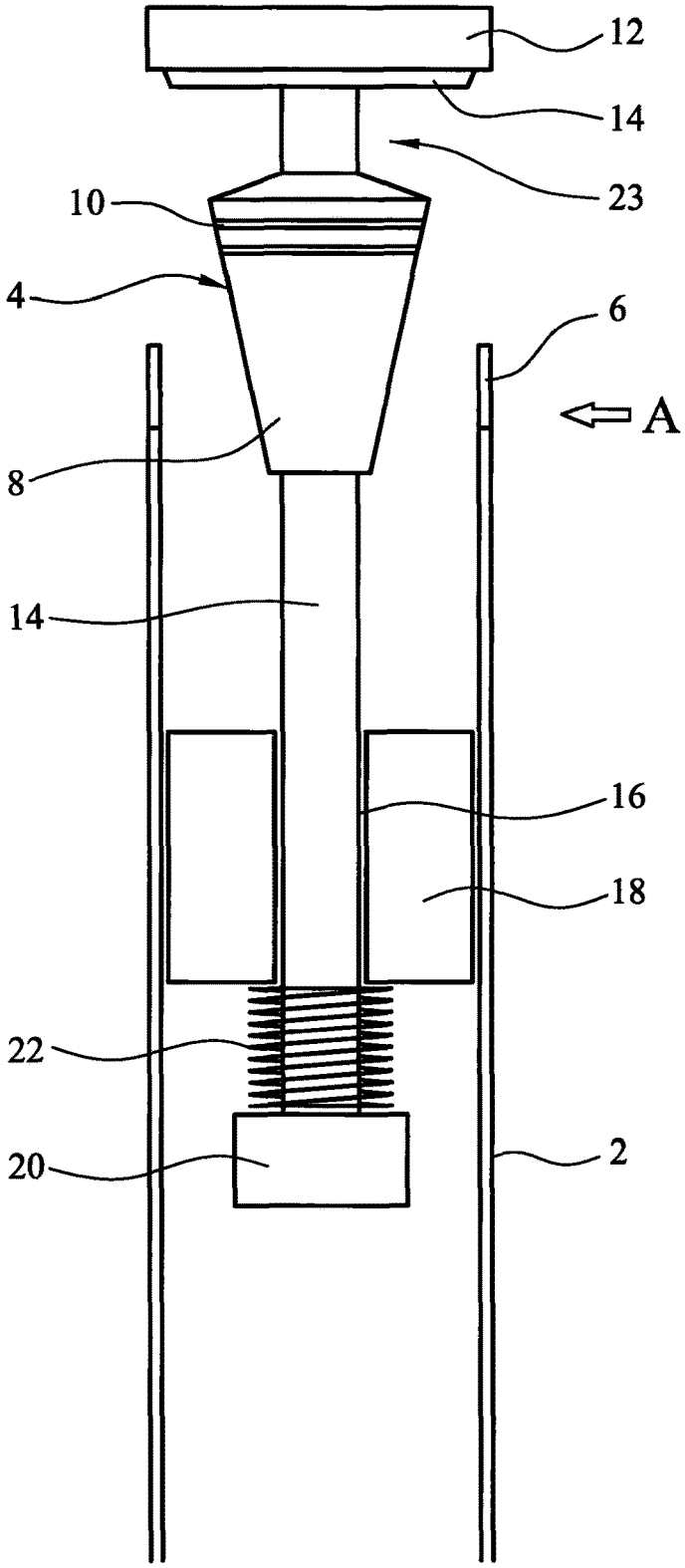

(58) Field of Classification Search
CPC . E04H 2017/1469; E04H 17/18; E04H 17/20; E04H 17/10; E04H 17/12; E04H 2017/1447; E04H 2017/1452
USPC ..... 404/6, 9; 49/49; 256/13.1
See application file for complete search history.

(56) References Cited

U.S. PATENT DOCUMENTS 1,267,568 A * 5/1918 McAlister ..... E04H 17/10 256/52
1,400,455 A * 12/1921 Peterson ..... E04H 17/12 52/155
1,459,116 A * 6/1923 Schmalz ..... E04H 17/10 256/52
1,712,752 A * 5/1929 Dandliker ..... E04H 17/10 256/57
1,792,331 A * 2/1931 Sollenberger ..... E04H 17/10 256/48
1,828,350 A * 10/1931 Williams ..... E04H 17/08 256/35
2,042,090 A * 5/1936 Cummins ..... E01F 15/06 403/284
2,315,516 A * 4/1943 Gray ..... E01F 13/026 256/1
2,317,248 A * 4/1943 Brickman ..... E01F 15/025 256/13.1
2,904,189 A * 9/1959 Eisert ..... D06F 57/12 211/119.1
3,194,537 A * 7/1965 Gerin ..... E01F 15/0446 256/13.1
3,240,475 A * 3/1966 Vegh ..... E04H 17/22 256/27
3,502,303 A * 3/1970 Bishop ..... E04H 17/12 256/48
3,782,322 A 1/1974 Wilson
4,944,493 A 7/1990 Handy
5,269,251 A 12/1993 Freeman
5,501,429 A * 3/1996 Sakuma ..... E01F 13/028 256/1
5,755,174 A 5/1998 Freeman
6,412,230 B1 * 7/2002 Zambelli ..... E04G 21/3261 52/27
6,547,725 B1 4/2003 Paolitto et al.
7,736,085 B2 * 6/2010 Neusch ..... E01F 13/12 404/6
8,087,846 B2 * 1/2012 Ringelberg ..... E01F 13/028 404/6
8,844,907 B1 * 9/2014 Davis ..... E04H 17/20 256/1
9,347,189 B2 5/2016 Eccless et al.
10,011,963 B2 * 7/2018 Eaton ..... E01F 13/028
2003/0111657 A1 * 6/2003 Green ..... A47F 10/00 256/45
2010/0232876 A1 9/2010 Ringelberg
2011/0220010 A1 * 9/2011 Klein ..... E01F 13/028 116/63 C
2013/0019537 A1 * 1/2013 Falcone ..... E01F 13/028 49/463

FOREIGN PATENT DOCUMENTS

EP 0303414 A1 2/1989
EP 0 685 602 A1 12/1995
GB 2 207 942 A 2/1989
GB 2 221 236 A 1/1990
GB 2 262 120 A 6/1993
WO 02/18707 A1 3/2002
WO WO-2005040499 A1 * 5/2005 ..... E01F 15/06
WO WO-2012037607 A1 * 3/2012 ..... E01F 15/06

OTHER PUBLICATIONS

Search Report under Section 17(5) issued in priority application No. GB1608561.5, dated Nov. 14, 2016. (4 pages).
Examination Report under Section 18(3) issued in priority application No. GB1608561.5, dated Jul. 26, 2018 (5 pages).
Combined Search and Examination Report under Sections 17 & 18(3) issued in related application No. GB1901837.3, dated Feb. 28, 2019. (5 pages).
First Examination Report issued in related application No. EP 17725718.5, dated Oct. 31, 2019. (7 pages).
Search Report under Section 17 issued in related application No. GB 1901837.3, dated Feb. 28, 2019. (1 page).
USPTO's Non-Final Office Action issued in related U.S. Appl. No. 6/745,088, dated Jun. 15, 2020. (11 pages).

* cited by examiner

BARRIER STAND

CROSS-REFERENCE TO RELATED APPLICATIONS

This application is a U.S. National Stage of International Application No. PCT/GB2017/000076, filed on 16 May 2017 and published on 23 Nov. 2017, as WO 2017/198984 A1, which claims the benefit of priority to GB Patent Application No. 1608561.5, filed on 16 May 2016. The content of each of the above referenced patent applications is incorporated herein by reference in its entirety for any purpose whatsoever.

The present invention relates to a barrier stand for a barrier comprising a cable such as an elasticated cord, and particularly, but not exclusively, a barrier to guide people in a certain path or to protect objects such as paintings, sculptures or precious items to be viewed by the general public by defining a closed area around or in front of the objects from which the general public are excluded.

Such barriers are in general known but can be expensive, awkward and time-consuming to install in locations where only a temporary barrier of a particular length is required, such as in art exhibitions, museums, car showrooms, events and retail environments where the exhibits may be changed from time to time for an exhibition, display or event.

The present invention seeks to provide a barrier stand to which a cable or cables can be quickly and inexpensively attached and to easily adjust the length of the cable between a plurality of barrier stands by employees with little or no expertise or experience.

According to the present invention there is provided a barrier stand for a barrier comprising a cable, the barrier stand comprising an elongate member of generally tubular form and being adapted to be mounted on a base so as to stand in a vertical position, and having a top section, at least one cable locating opening or recess extending downwardly from the top of the top section and being open at its upper end, the or each cable locating opening or recess being adapted to receive a cable, and a clamping device located in the top section and being biased resiliently to a clamping position for clamping a cable securely to the stand, wherein the clamping device has a clamping surface to clamp a cable between the clamping device and the top section.

Preferably, the clamping device is movable manually relative to the elongate member against the bias to enable a cable to be inserted into the top section through the or each cable locating opening or recess.

In a preferred embodiment, the clamping surface is defined by a frusto-conical section.

Preferably, the clamping device has a cap adapted to close the upper end of the top section of the barrier stand when the clamping device is in the clamping position and in this arrangement may include a guide secured in the upright member to guide the cap into position to close the open end of the top section when the clamping device is lowered into the clamping position by the resilient bias.

Preferably, the clamping device includes a shaft extending from the frusto-conical section through said guide, the shaft having a spring mounting flange on the side of the guide remote from the frusto-conical section, a spring being located between the flange and the guide to bias the clamping device to the closed position.

In a preferred form, the barrier stand has a plurality of said cable locating openings or recesses disposed about the top section preferably four cable locating openings or recesses disposed equidistantly about the top section.

In a preferred embodiment, each cable locating opening or recess is between 3-5 mm in width and 5-10 mm in length and is adapted to support an elastic cable. In this embodiment, the cable is preferably an elastic cable having a diameter 1-1.5 mm larger than the width of the cable locating opening or recess. Preferably the cable locating opening or recess is 4 mm in width and the elastic cable is 5 mm in diameter.

Figure 2:
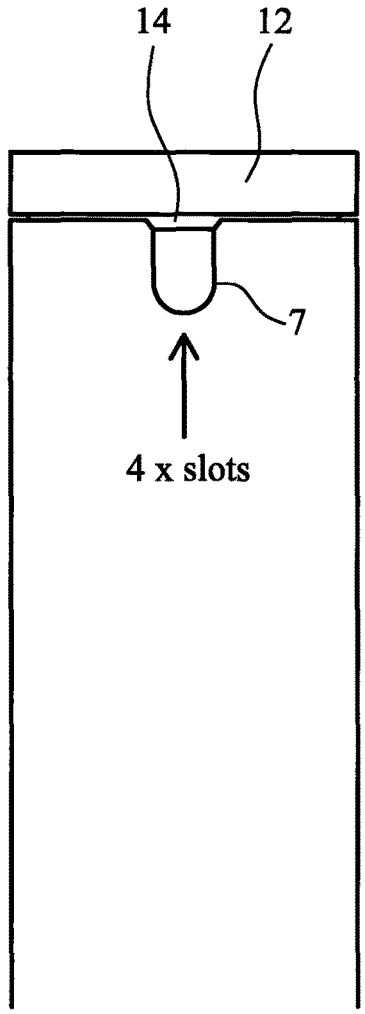

A preferred embodiment of the present invention will now be described by way of example with reference to the accompanying schematic drawing, in which FIG. 1 shows a schematic cross-sectional view through the barrier stand, and FIG. 2 shows a side view of the barrier stand in the direction of the arrow A.

Referring now to FIG. 1 in particular, there is shown a sectional view of a barrier stand consisting of cylindrical tubular upright member 2 which contains a clamping device 4 formed, in this embodiment, predominantly of stainless steel. In other embodiments, the device may be formed of other materials, such as moulded plastics. At its lower end, not shown, the upright member 2 is adapted to be secured on a mounting base to locate the upright member firmly in the vertical position. At its upper open end, in this embodiment, the upright member has four equidistantly spaced slots 6, spaced about the periphery of the open end. Each slot is open at its outer end and is between 3-5 mm in width and approximately 5-10 mm in length. At the lower end each slot 6 terminates in an arcuate curve 7, as shown in FIG. 2. In other embodiments, a different number of slots may be provided.

The clamping device comprises a frusto-conical section 8 which forms a clamping surface and to improve the clamping properties may have a roughened surface, which in this embodiment is in the form, as shown, of a plurality of concentric ridges 10. The angle of the conical part is typically a maximum of 10 degrees but may be as low as 2 degrees. The larger diameter part of the frusto-conical section is at the upper end of the clamping device and tapers inwardly to a shaft 14 extending downwardly. The clamping member 4 has a cap 12 having a diameter the same as that of the upright member 2 and has on its underside a section of reduced diameter 14 which serves to locate the cap accurately in position on top of the upright member 2 to give a smooth neat snag-free finish.

The shaft 14 extends with a close sliding fit through a bore 16 in a guide 18 secured to the upright member 2 which also serves to ensure that the cap 12 is maintained closely aligned with the upright member 2. The bore 16 is approximately 25 mm long. At its end remote from the frusto-conical section 8, the shaft has a spring mounting flange 20 which serves as a mounting for a coil spring 22 located between the flange 20 and the guide 18 to thereby resiliently bias the shaft 14 and hence the clamping device downwardly to a clamping position. The maximum lift of the cap is in the region of 15-20 mm.

In operation, this embodiment is intended for use with an elastic cable of 5 mm diameter and the slots are designed to be 4 mm in width. To secure the cable to the stand, the clamping device 4 is lifted upwardly against the resilient bias and the end of the cable (not shown) is inserted into the gap between the top edge of the tubular member 2 and the frusto-conical surface so that the free end of the cable extends downwardly into the tubular member 2 and is compressed to be pushed down into the slot 6. The clamping device is then released and the end of the cable within the tubular member 2 is clamped between the inner surface of the tubular member 2 adjacent to the slot 6 and the clamping surface 8 of the frusto-conical section. The cable is then stretched from the barrier stand to either another barrier stand in a long barrier or to a fixed mounting point, on a wall for example.

It is envisaged that a long cable can be attached to a plurality of the stands by pressing the cable onto one slot 6 and then passing the remainder of the cable over the top of the frusto-conical section 8 so that it sits within the recess 23 when the cap is depressed and out of the stand through another slot 6 where it is also secured by being compressed into the slot. Thus, the one long cable can be secured to a plurality of the barrier stands to form a particular configuration of barrier with changes of direction through 90° or straight on when four slots are provided.

Although described with reference to the use of an elastic cable, it will be understood that the barrier stand can also be used with essentially non-elastic cable providing the size of the slot is appropriate for the cable being used.

Moreover, it should be clear to the skilled person that the slot described above could be an opening, a recess, a roughened surface or any other suitable cable locating means.

The invention claimed is:

1. A barrier stand for a barrier comprising a cable, the barrier stand comprising:

an elongate member of substantially tubular form, the elongate member being adapted to be mounted on a base so as to stand in a vertical position, the elongate member having a top section open at an upper end, the elongate member defining at least one cable locating opening extending downwardly from a top of the top section, the at least one cable locating opening being adapted to receive the cable;

a freely slidable clamping device located in the top section and being moveable vertically within the elongate member between an unclamped position when the clamping device is slid upward and out of the elongate member, and a clamping position for clamping the cable securely to the barrier stand, when the clamping device is slid downward into the elongate member, such that a clamping surface of the clamping device is arranged to clamp the cable between the clamping surface and the top section of the elongate member when the clamping device is in the clamping position;

wherein a section of the clamping device that defines the clamping surface is larger towards an upper end of the clamping device than a lower end of the clamping device so that movement of the clamping device downwardly towards the clamping position narrows the gap between the clamping surface and said top section of the elongate member, thereby clamping the cable therebetween;

and a shaft and a guide, the guide being secured within the elongate member, and the guide defining a bore through which the shaft is slidable, wherein the shaft is connected with the clamping surface so that the clamping surface is slidable upwardly and downwardly relative to and along the elongate member.

2. The barrier stand of claim 1, wherein the section of the clamping device that defines the clamping surface comprises a plurality of concentric ridges to improve clamping.

3. The barrier stand of claim 1, wherein the section of the clamping device that defines the clamping surface is a frusto-conical section that has a diameter that is larger toward the upper end than the lower end of the clamping device, and tapers inwardly towards the lower end of the clamping device.

4. The barrier stand of claim 1, wherein the clamping device is movable relative to the elongate member away from the clamping position to enable the cable to be inserted into the top section through the at least one cable locating opening.

5. The barrier stand of claim 1, wherein the cable is an elastic cable of 1-1.5 mm diameter larger than a width of the at least one cable locating opening.

6. The barrier stand of claim 1, further comprising a cap adapted to close the upper end of the top section of the elongate member when the clamping device is in the clamping position.

7. The barrier stand of claim 1, further comprising a cap adapted to close the upper end of the top section of the elongate member when the clamping device is in the clamping position, wherein the cap is connected to the shaft, and the shaft extends with a close sliding fit through the bore so that the cap is maintained in close alignment with the upper end of the top section of the elongate member during movement of the clamping device towards the clamping position.

8. The barrier stand of claim 7, wherein the cap is connected to the shaft via a section of the clamping device that defines the clamping surface.

9. The barrier stand of claim 1, wherein the clamping device is biased resiliently at least one of towards and away from the clamping position.

10. A barrier stand for a barrier comprising an elastic cable, the barrier stand comprising:

an elongate member of tubular form adapted to be mounted on a base so as to stand in a vertical position;

the elongate member having a top section open at an upper end for receiving a freely slidable clamping device;

the elongate member defining at least one cable locating recess situated near a top of the top section, the at least one cable locating recess being adapted to receive the elastic cable, the elastic cable having a diameter larger than the width of the at least one cable locating recess; and the freely slidable clamping device being moveable vertically within the elongate member between an unclamped position when the clamping device is slid upward and out of the elongate member, and a clamping position for clamping the elastic cable securely to the barrier stand, when the clamping device is slid downward into the elongate member;

wherein the barrier stand further comprises a clamping device being located in the top section and being moveable relative to the elongate member to a clamping position for clamping the elastic cable securely to the barrier stand, the clamping device having a clamping surface arranged to clamp the elastic cable between the clamping surface and said top section of the elongate member when the clamping device is in the clamping position;

wherein a section of the clamping device that defines the clamping surface is larger towards an upper end of the clamping device than a lower end of the clamping device so that movement of the clamping device downwardly towards the clamping position narrows the gap between the clamping surface and said top section of the elongate member, thereby clamping the elastic cable there-between, the section of the clamping device that defines the clamping surface comprising a plurality of concentric ridges; and the barrier stand further comprises a shaft and a guide, the guide being secured within the elongate member, and the guide defining a bore through which the shaft is slidable, wherein the shaft is connected with the clamping surface so that the clamping surface is slidable upwardly and downwardly relative to and along the elongate member.

11. The barrier stand of claim 10, wherein the section of the clamping device that defines the clamping surface has a diameter that is larger toward the upper end than the lower end of the clamping device, and tapers inwardly towards the lower end of the clamping device.

12. A barrier defined by a plurality of spaced barrier stands and at least one cable extending therebetween, each of the plurality of spaced barrier stands comprising an elongate member of tubular form and being adapted to be mounted on a base so as to stand in a vertical position, the elongate member having a top section open at an upper end for receiving a freely slidable clamping device, defining a plurality of cable locating recesses situated near a top of the top section, each of the plurality of cable locating recesses being adapted to receive the at least one cable, and the freely slidable clamping device being moveable vertically within the elongate member between an unclamped position when the clamping device is slid upward and out of the elongate member, and a clamping position for clamping the cable securely to the barrier stand, when the clamping device is slid downward into the elongate member, such that a clamping surface of the clamping device is arranged to clamp the at least one cable between the clamping surface and the top section of the elongate member when the clamping device is in the clamping position;

wherein at least one of the plurality of barrier stands further comprises a clamping device being located in the top section and being moveable relative to the elongate member to a clamping position for clamping the at least one cable securely to the barrier stand, the clamping device having a clamping surface arranged to clamp each of the at least one cable between the clamping surface and said top section of the elongate member when the clamping device is in the clamping position; and wherein a section of the clamping device that defines the clamping surface is larger towards an upper end of the clamping device than a lower end of the clamping device so that movement of the clamping device downwardly towards the clamping position narrows the gap between the clamping surface and said top section of the elongate member, thereby clamping each of the at least one cable there-between;

wherein at least one of the plurality of barrier stands further comprises a shaft and a guide, the guide being secured within the elongate member, and the guide defining a bore through which the shaft is slidable, wherein the shaft is connected with the clamping surface so that the clamping surface is slidable upwardly and downwardly relative to and along the elongate member.

* * * * *